US006783446B1

(12) United States Patent
Suzuki et al.

(10) Patent No.: US 6,783,446 B1
(45) **Date of Patent: *Aug. 31, 2004**

(54) CHEMICAL MECHANICAL POLISHING APPARATUS AND METHOD OF CHEMICAL MECHANICAL POLISHING

(75) Inventors: Mieko Suzuki, Tokyo (JP); Yasuaki Tsuchiya, Tokyo (JP)

(73) Assignee: NEC Electronics Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 8 days.

(21) Appl. No.: 09/256,707

(22) Filed: Feb. 24, 1999

(30) Foreign Application Priority Data

Feb. 26, 1998 (JP) ..... 10-045372

(51) Int. Cl.[7] ..... B24B 29/00

(52) U.S. Cl. ..... 451/288; 451/41; 451/261; 451/283

(58) Field of Search ..... 451/41, 268, 283, 451/287, 288, 60, 271, 291

(56) References Cited

U.S. PATENT DOCUMENTS 5,329,734 A * 7/1994 Yu ..... 451/41
5,554,064 A * 9/1996 Breivogel et al. ..... 451/41
5,800,248 A * 9/1998 Pant et al. ..... 451/41
5,816,900 A * 10/1998 Nagahara et al. ..... 451/285
5,853,317 A * 12/1998 Yamamoto
5,879,225 A * 3/1999 Kudo et al. ..... 451/271
5,944,583 A * 8/1999 Cruz et al.
5,957,750 A * 9/1999 Brunelli
5,964,646 A * 10/1999 Kassir et al.

FOREIGN PATENT DOCUMENTS

JP 513389 1/1993 ..... H01L/21/304
TW 301772 4/1997 ..... H01L/21/304

* cited by examiner

*Primary Examiner*—Joseph J. Hail, III
*Assistant Examiner*—Alvin J Grant
(74) *Attorney, Agent, or Firm*—Hayes Soloway P.C.

(57) ABSTRACT

There is provided an apparatus for polishing a substrate, including (a) a polishing pad formed with a plurality of through-holes through which polishing material is supplied to a surface of the polishing pad, (b) a level block on which the polishing pad is mounted, and (c) a rotatable carrier for supporting a substrate thereon, the carrier being positioned in facing relation with the level block, the level block being rotatable around a rotation axis thereof with the rotation axis being moved along an arcuate path, and causing the polishing pad to make contact with the substrate for polishing the substrate, the polishing pad having a first ring-shaped region concentric thereto where no through-holes are formed. For instance, the first ring-shaped region has a width greater than 10%, but smaller than 95% of a radius of the polishing pad. The apparatus enhances uniformity in polishing a substrate.

19 Claims, 8 Drawing Sheets

$0.3R \leqq r \leqq 0.95R$

CHEMICAL MECHANICAL POLISHING APPARATUS AND METHOD OF CHEMICAL MECHANICAL POLISHING

BACKGROUND OF THE INVENTION

1. Field of the Invention

The invention relates to an apparatus for polishing a substrate for planarization by chemical mechanical polishing. The invention relates further to a method of chemical mechanical polishing.

2. Description of the Related Art

FIGS. 1A to 1E illustrate respective steps in a method of forming a buried metal layer in a semiconductor device.

First, as illustrated in FIG. 1A, a semiconductor substrate 101 including active devices fabricated thereon is covered entirely with an insulating film 102.

Then, a resist film 105 having a certain pattern is formed on the insulating film 102, and subsequently, the insulating film 102 is etched with the patterned resist film 105 being used as a mask, to thereby form a contact hole 106 through the insulating film 102, as illustrated in FIG. 1B.

After removal of the resist film 105, as illustrated in FIG. 1C, a barrier film 103 composed of metal such as Ti or Ta is deposited over the insulating film 102 so that the contact hole 106 is covered at a sidewall and a bottom thereof with the barrier film 103.

Then, as illustrated in FIG. 1D, an electrically conductive layer 104 is deposited over the product to thereby fill the contact hole 106 with the electrically conductive layer 104.

Then, the electrically conductive film 104 is planarized by means of a chemical mechanical polishing apparatus 107, as illustrated in FIG. 1E. Thus, a buried metal layer 108 is formed.

The chemical mechanical polishing apparatus 107 includes a carrier on which a wafer to be polished is fixed, and a rotatable level block on which a polishing pad is mounted. A wafer is compressed onto a rotating polishing pad to thereby be polished. While a wafer is being polished by the polishing pad, polishing powder such as alumina or silica, and polishing slurry containing etchant such as $H_2O_2$ are supplied between the polishing pad and the wafer.

FIG. 2 illustrates a conventional apparatus for polishing a wafer by chemical mechanical polishing. The illustrated apparatus is comprised of a level block 23 connected to a rotatable shaft 24, a polishing pad 29 fixed onto the level block 23, a wafer holder 26 connected to a rotatable shaft 27 and holding a wafer 25 on a bottom thereof, and a slurry source 30 supplying polishing slurry onto the polishing pad 29 through a slurry supply port 21.

The wafer 25 is sandwiched between the polishing pad 29 and the wafer holder 26. While the wafer 25 is being polished by the polishing pad 29, polishing slurry 22 is supplied between the polishing pad 29 and the wafer 25 around a periphery of the wafer 25.

Though the illustrated apparatus is designed to have one wafer holder 26, the apparatus may be designed to have a plurality of wafer holders 26. For instance, the apparatus may be designed to have four wafer holders 26 equally spaced from one another above the level block 23 in order to concurrently polish four wafers at a time.

A conventional apparatus for polishing a wafer, such as the apparatus illustrated in FIG. 2, is accompanied with a problem of non-uniformity in polishing speed in a wafer, which results in that a wafer is polished around a center thereof to a greater degree than a periphery thereof.

In order to overcome this problem, there has been suggested a first polishing apparatus in which a polishing pad mounted on a level block is formed with a plurality of small through-holes through which polishing slurry is supplied onto a surface of the polishing pad from a polishing slurry source. The small through-holes are positioned in concentration with an axis of the polishing pad 29. Since polishing slurry is uniformly supplied between a wafer and the polishing pad, it would be possible to keep a polishing speed constant to thereby enhance uniformity in polishing a wafer.

There has been suggested also a second polishing apparatus in which a polishing pad is composed of porous material in order to enhance uniformity in polishing a wafer.

However, since a wafer having a greater diameter is compressed onto a polishing pad at a greater pressure around a center thereof than a periphery thereof, a polished wafer would have a cross-section like a cross-section of a concave lens, if a wafer is polished in accordance with the above-mentioned first or second polishing apparatuses in which polishing slurry is uniformly supplied to a surface of a wafer, whereas a polished wafer would have a cross-section like a convex lens, if a wafer is polished in accordance with the apparatus illustrated in FIG. 2.

In order to avoid this problem, Japanese Unexamined Patent Publication No. 5-13389 has suggested a polishing apparatus which has the same structure as that of the above-mentioned first and second polishing apparatus, but is capable of controlling an amount of polishing slurry at a predetermined position of a polishing pad for the purpose of enhancing uniformity in polishing a wafer.

Specifically, the suggested polishing apparatus is formed with a plurality of through-holes through which polishing slurry is supplied onto a surface of a polishing pad, in such a manner that the number of through-holes per a unit area in a region closer to a center of a polishing pad is designed to be greater than the number of through-holes per a unit area in a region closer to a periphery of a polishing pad, or that a through-hole located closer to a center of a polishing pad is designed to have a greater diameter than a diameter of a through-hole located closer to a periphery of a polishing pad.

A diameter of a wafer necessary to be polished is increasing. For instance, a diameter of a wafer to be polished years ago was 6 inches (about 15 cm), but a diameter of a wafer to be polished presently is in the range of 8 to 10 inches (about 20 to about 25 cm). Such a wafer having a great diameter could not be polished by means of such an apparatus as illustrated in FIG. 2, because the level block 23 has to have too much area, which results in too high load to the apparatus.

Hence, there has been suggested such a polishing apparatus as illustrated in FIG. 3A, in order to avoid the above-mentioned problem. The illustrated apparatus is comprised of a rotatable carrier 2 supporting a wafer 1 at a bottom thereof, a level block 3, a polishing pad 4 mounted on the level block 3 and positioned in facing relation to the carrier 2, and a motor 5 for rotating the level block 3 around a rotation axis. The polishing pad 4 is formed with a plurality of through-holes equally spaced from one another.

The wafer 2 is made to rotate, and then, is compressed onto the rotating polishing pad 4. While the wafer 1 is being polished. While the wafer 2 is being polished, slurry 6 is supplied onto a surface of the polishing pad 4 through the through-holes.

In order to enhance uniformity in polishing the wafer 1, the level block 3 is rotated by means of the motor 5 in such a manner that the rotation axis of the level block 3 moves along an arcuate path. That is, the level block 3 makes so-called orbital revolution.

FIG. 4 shows a positional relation in orbital revolution between the wafer 1 rotating around a rotation axis A and the polishing pad 4 rotating around a rotation axis B. As illustrated in FIG. 4, if viewed from the rotation axis A, the rotation axis B rotates around the rotation axis A.

As mentioned earlier, if a wafer is polished with polishing slurry being supplied onto a surface of a polishing pad through through-holes formed with the polishing pad, there is caused a problem that a wafer is polished to a greater degree in a central region than in a peripheral region, resulting in that a wafer is concave in a central region thereof. If a wafer is non-uniformly polished as mentioned above, an electrically conductive film such as the electrically conductive film 104 illustrated in FIG. 1D partially remains non-removed on an insulating film such as the insulating film 102, resulting in current leakage between wirings.

In order to avoid such a problem, it is necessary to sufficiently polish a wafer. However, this may result in that a wiring to be formed on an insulating film has different heights above a central region and a peripheral region of a wafer. Accordingly, a wiring resistance above a central region of a wafer becomes different from a wiring resistance above a peripheral region of a wafer with the result of deterioration in electro-migration (EM).

SUMMARY OF THE INVENTION

It is an object of the present invention to provide an apparatus for polishing a wafer, which apparatus is capable of enhancing uniformity in polishing. It is also an object of the present invention to provide a method of doing the same.

The inventors had conducted a lot of experiments in order to accomplish the above-mentioned object, and had found out that if a polishing pad is designed to include a region where there are formed no through-holes through which polishing slurry is supplied to a surface of the polishing pad, it would be possible to enhance uniformity in polishing a wafer.

Specifically, in one aspect of the invention, there is provided an apparatus for polishing a substrate, including (a) a polishing pad formed with a plurality of through-holes through which polishing material is supplied to a surface of the polishing pad, (b) a level block on which the polishing pad is mounted, and (c) a rotatable carrier for supporting a substrate thereon, the carrier being positioned in facing relation with the level block, the level block being rotatable around a rotation axis thereof with the rotation axis being moved along an arcuate path, and causing the polishing pad to make contact with the substrate for polishing the substrate, the polishing pad having a first ring-shaped region concentric thereto where no through-holes are formed.

It is preferable that the first ring-shaped region has a width equal to or greater than 10%, more preferably 20%, of a radius of the polishing pad.

It is preferable that the through-holes are positioned in alignment with a peripheral region of the substrate when an axis of the level block is in alignment with an axis of the carrier.

It is preferable that the through-holes are positioned in a second ring-shaped region having an outer periphery common to an outer periphery of the polishing pad and having a width equal to 5% or smaller of a radius of the polishing pad.

It is preferable that the polishing pad includes a circular region concentric to the polishing pad and located inside the first ring-shaped region, and a third ring-shaped region located outside the first ring-shaped region, the circular region and the third ring-shaped region including the through-holes therein. In this arrangement, it is preferable that the third ring-shaped region has an outer periphery common to an outer periphery of the polishing pad. It is also preferable that the through-holes formed in the third ring-shaped region are positioned in alignment with a peripheral region of the substrate when an axis of the level block is in alignment with an axis of the carrier.

It is preferable that a total area of the through-holes varies in a radius-wise direction of the, polishing pad. For instance, the number of the through-holes per a unit area may be designed to decrease in a direction from an outer periphery to a center of the polishing pad. As an alternative, diameters of the through-holes may be designed to decrease in a direction from an outer periphery to a center of the polishing pad.

There is further provided an apparatus for polishing a substrate, including (a) a polishing pad formed with a plurality of through-holes through which polishing material is supplied to a surface of the polishing pad, (b) a level block on which the polishing pad is mounted, and (c) a rotatable carrier for supporting a substrate thereon, the carrier being positioned in facing relation with the level block, the level block being rotatable around a rotation axis thereof with the rotation axis being moved along an arcuate path, and causing the polishing pad to make contact with the substrate for polishing the substrate, the polishing pad having a circular region concentric thereto where no through-holes are formed.

It is preferable that the circular region has a radius equal to or smaller than 95% of a radius of the polishing pad.

It is preferable that the circular region has a radius equal to or greater than 30% of a radius of the polishing pad.

In another aspect of the present invention, there is provided a method of carrying out chemical mechanical polishing to a substrate, including the steps of (a) rotating a level block on which a polishing pad is mounted, relative to a carrier on which a substrate is mounted, around a rotation axis thereof with the rotation axis being moved along an arcuate path, and (b) supplying polishing material on a surface of the polishing pad while the substrate is being polished by the polishing pad, in a region other than a first ring-shaped region concentric to the polishing pad.

For instance, the polishing material may be supplied on a surface of the polishing pad through through-holes formed with the polishing pad.

It is preferable that the polishing material is supplied on a surface of the polishing pad in a second ring-shaped region having an outer periphery common to an outer periphery of the polishing pad and having a width equal to 5% or smaller of a radius of the polishing pad.

It is preferable that the polishing pad includes a circular region concentric to the polishing pad and located inside the first ring-shaped region, and a third ring-shaped region located outside the first ring-shaped region, the polishing material being supplied into the circular region and the third ring-shaped region.

It is preferable that the polishing material is supplied onto a surface of the polishing pad in a varying amount in a radius-wise direction of the polishing pad. For instance, the polishing material may be supplied in a greater amount in a region closer to a center of the polishing pad.

There is further provided a method of carrying out chemical mechanical polishing to a substrate, including the steps of (a) rotating a level block on which a polishing pad is mounted, relative to a carrier on which a substrate is mounted, around a rotation axis thereof with the rotation axis being moved along an arcuate path, and (b) supplying polishing material on a surface of the polishing pad while the substrate is being polished by the polishing pad, in a region other than a circular region concentric to the polishing pad.

It is preferable that the circular region has a radius equal to or smaller than 95% of a radius of the polishing pad.

It is preferable that the circular region has a radius equal to or greater than 30% of a radius of the polishing pad.

In the apparatus in accordance with the present invention, a polishing pad is designed to have a region in which through-holes through which polishing material is supplied to a surface of the polishing pad are not formed. In the method in accordance with the present invention, polishing material is supplied to a surface of a polishing pad in a region other than a certain region of the polishing pad. As a result, the present invention makes it possible to accomplish uniformity in polishing rate in a high degree. Hence, when a buried metal layer is to be formed by chemical mechanical polishing, a resultant semiconductor device could have superior resistance to electro-migration (EM).

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Figure 3A:
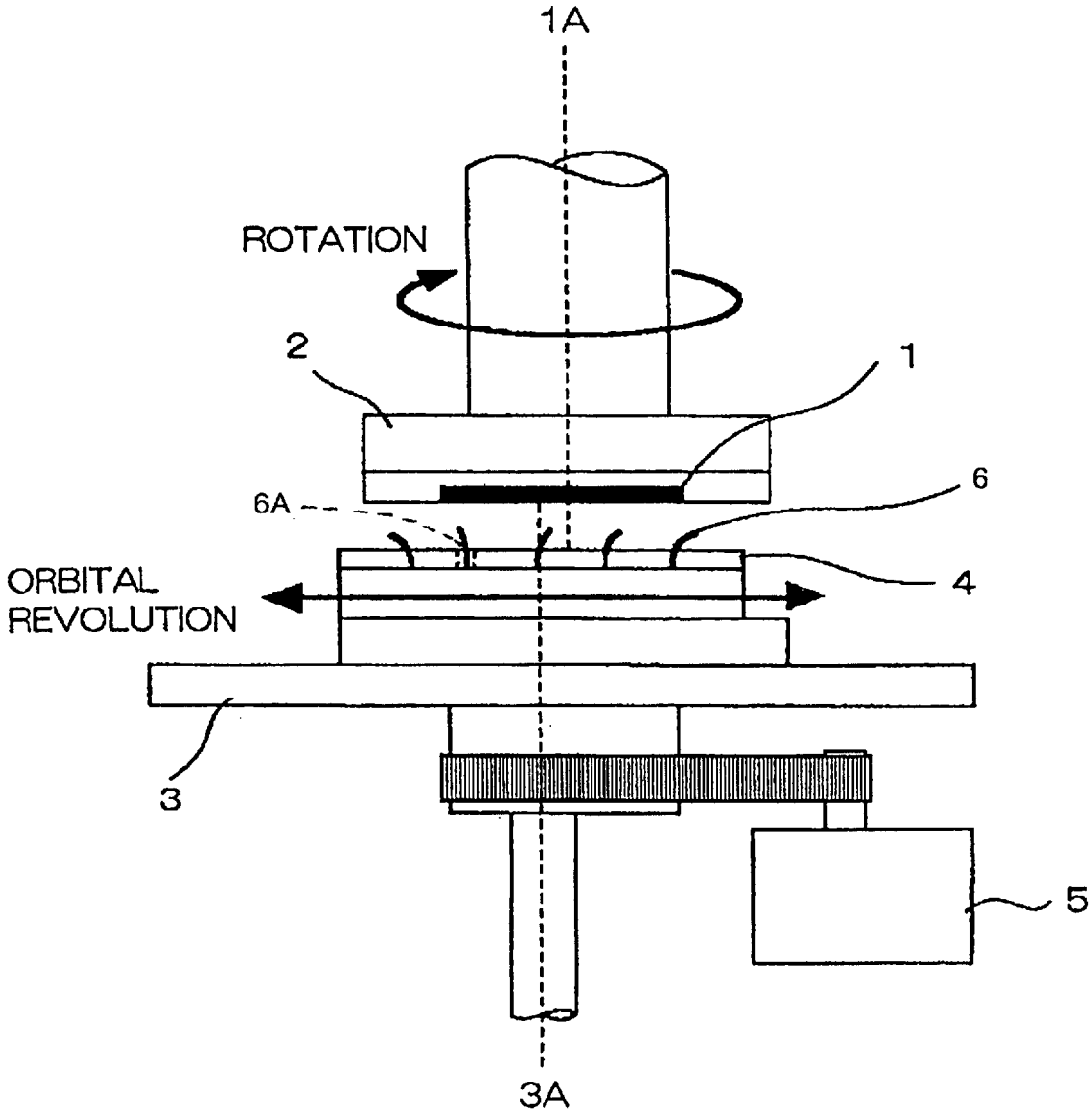
FIG. 3A illustrates an apparatus for polishing a wafer, to which apparatus the present invention may be applied.

FIG. 3A illustrates an apparatus for polishing a substrate, in accordance with the first embodiment of the present invention.

The illustrated apparatus is comprised of a polishing pad 4 formed with a plurality of through-holes (shown in phantom at 6A) through which polishing slurry 6 is supplied to a surface of the polishing pad 4, a level block 3 on which the polishing pad 4 is mounted, a motor 5 for rotating the level block 3 around a rotation axis, and a rotatable carrier 2 for supporting a wafer 1 at a bottom surface thereof in facing relation with the polishing pad 4.

Figure 4:
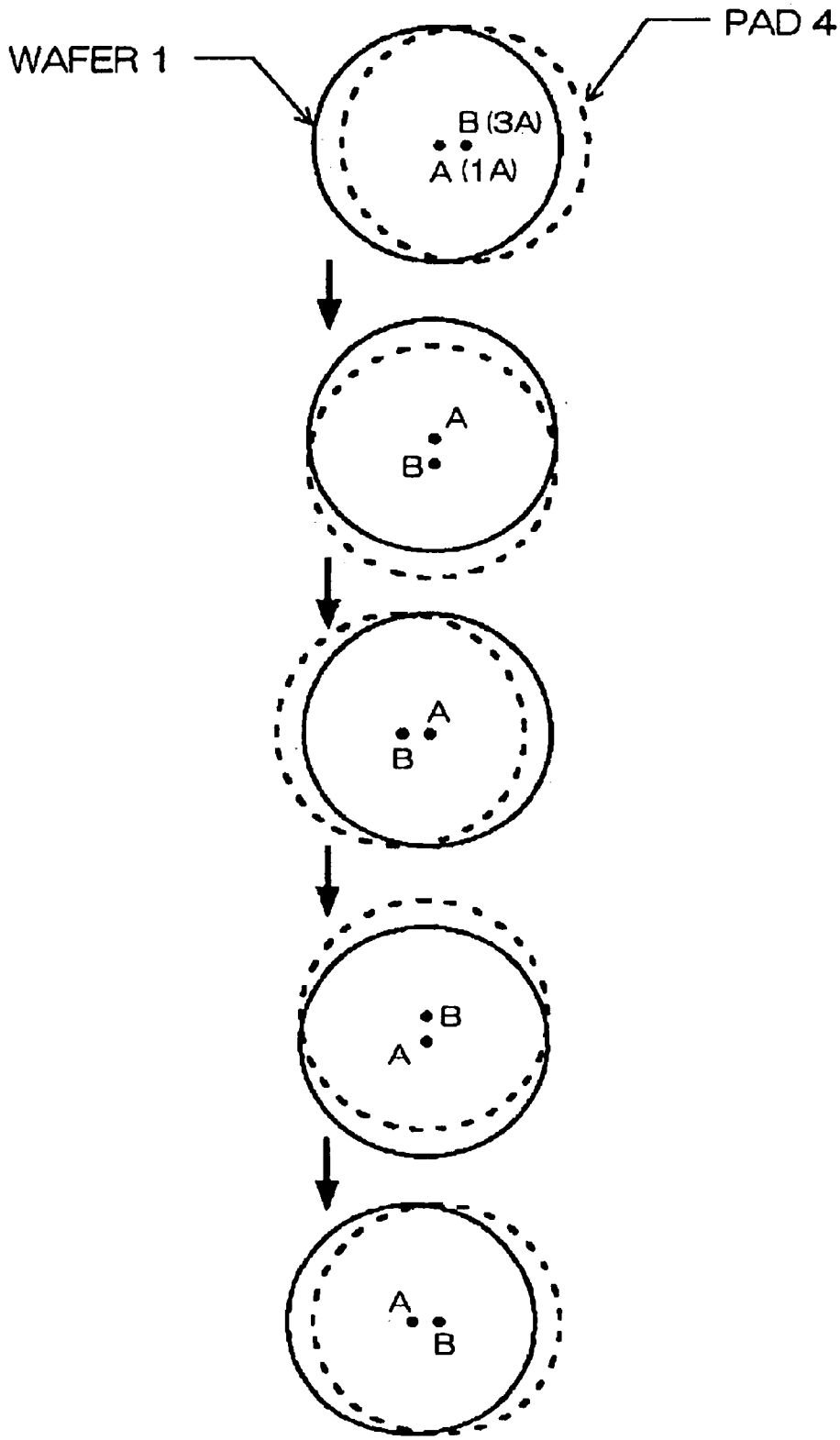
FIG. 4 illustrates a positional relation between two rotation axes in orbital revolution.

Though the wafer 1 is rotated around a stationary rotation axis 1A thereof, the polishing pad 4 makes orbital revolution around the rotation axis 1A of the wafer 1. Specifically, the level block 3 and hence the polishing pad 4 are rotated around a rotation axis 3A thereof, and, at the same time, the rotation axis 3A is moved along an arcuate path. That is, as illustrated in FIG. 4, if viewed from the rotation axis 1A, the rotation axis 3A rotates around the rotation axis 1A.

The wafer 1 is compressed onto the polishing pad 4 to thereby be polished.

Figure 3B:
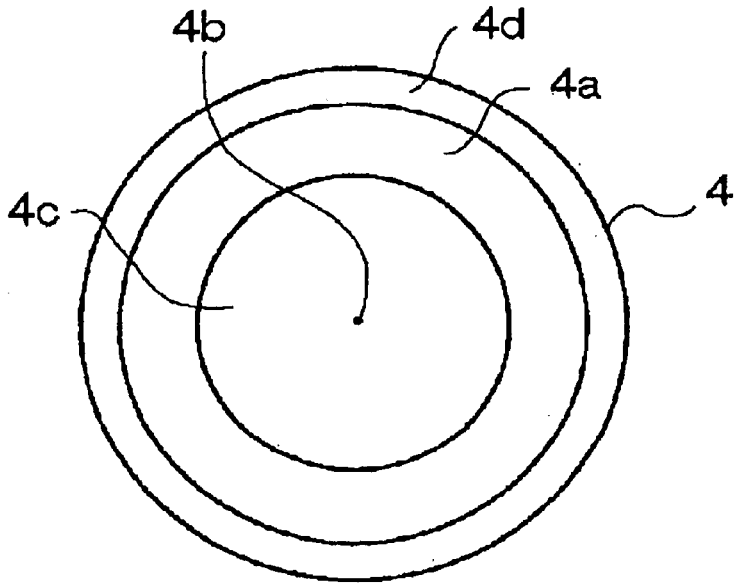
FIG. 3B is a plan view of a polishing pad employed in the apparatus illustrated in FIG. 3A.

The polishing pad 4 is designed to have a first ring-shaped region 4*a* which is concentric to a center 4*b* of the polishing pad 4, as illustrated in FIG. 3B. The through-holes through which the polishing slurry 6 is supplied to a surface of the polishing pad 4 are formed in a region, other than the first ring-shaped region 4*a,* namely, in both a circular region 4*c* located inside the first ring-shaped region 4*a* and a ring-shaped region 4*d* located outside the first ring-shaped region 4*a,* whereas no through-holes are formed in the first ring-shaped region 4*a.*

The apparatus in accordance with the first embodiment includes the polishing pad 4 which is designed to have the first ring-shaped region 4*a* where there are formed no through-holes through which the polishing slurry 6 is supplied to a surface of the polishing pad 4. The wafer 1 is certainly polished in the first ring-shaped region 4*a,* resulting in a polishing condition where high uniformity in a polishing rate is established.

It is preferable that the first ring-shaped region 4*a* has a width equal to or greater than 10% of a radius of the polishing pad 4 for accomplishing sufficient uniformity in a polishing rate. It is more preferable that the first ring-shaped region 4*a* has a width equal to or greater than 20% of a radius of the polishing pad 4.

It is also preferable that the polishing pad 4 is formed at a peripheral region thereof with the through-holes. It is more preferable that the through-holes are formed in the polishing pad 4 in alignment with a peripheral region of the wafer 1, when the axis 3A of the polishing pad 4 is in alignment with the axis 1A of the wafer 1.

The polishing pad 4 may be designed to be formed with the through-holes in a central region thereof, or may be designed to be formed with no through-holes in a central region thereof. If no through-holes are formed in a central region of the polishing pad 4, it is preferable that no through-holes are formed in a circular region outwardly radially extending from a center of the polishing pad 4 and having a radius equal to or greater than 30% of a radius of the polishing pad 4.

When hard material is to be polished, it is preferable that the through-holes are formed in a central region of the polishing pad 4, which ensures higher uniformity in a polishing rate.

In later mentioned examples, there was conducted an experiment in which the through-holes are closed. However, in practical use, the through-holes are formed in a polishing pad in predetermined positions.

It is not always necessary to uniformly position the through-holes in a surface of the polishing pad 4. A total area of the through-holes may be designed to vary in a radius-wise direction of the polishing pad 4. For instance, the number of the through-holes per a unit area may be designed to decrease in a direction from an outer periphery to a center of the polishing pad 4. As an alternative, the through-holes may be designed to have a decreasing diameter in a direction from an outer periphery to a center of the polishing pad 4.

Hereinbelow are explained the experiments in which a wafer was polished by means of the apparatus in accordance with the above-mentioned embodiment.

EXAMPLE 1

As a wafer to be polished, there was used a wafer which had a diameter of 8 inches (about 20 cm) and on which metal films composed of Cu. Ta, and TiN were formed. The wafer was polished by means of the apparatus illustrated in FIG. 3A. A polishing pad was formed uniformly with the through-holes, and had a diameter of 10 inches (about 25 cm).

The wafer was polished with the through-holes located closer to a center of the polishing pad, being closed one by one.

Figure 5:
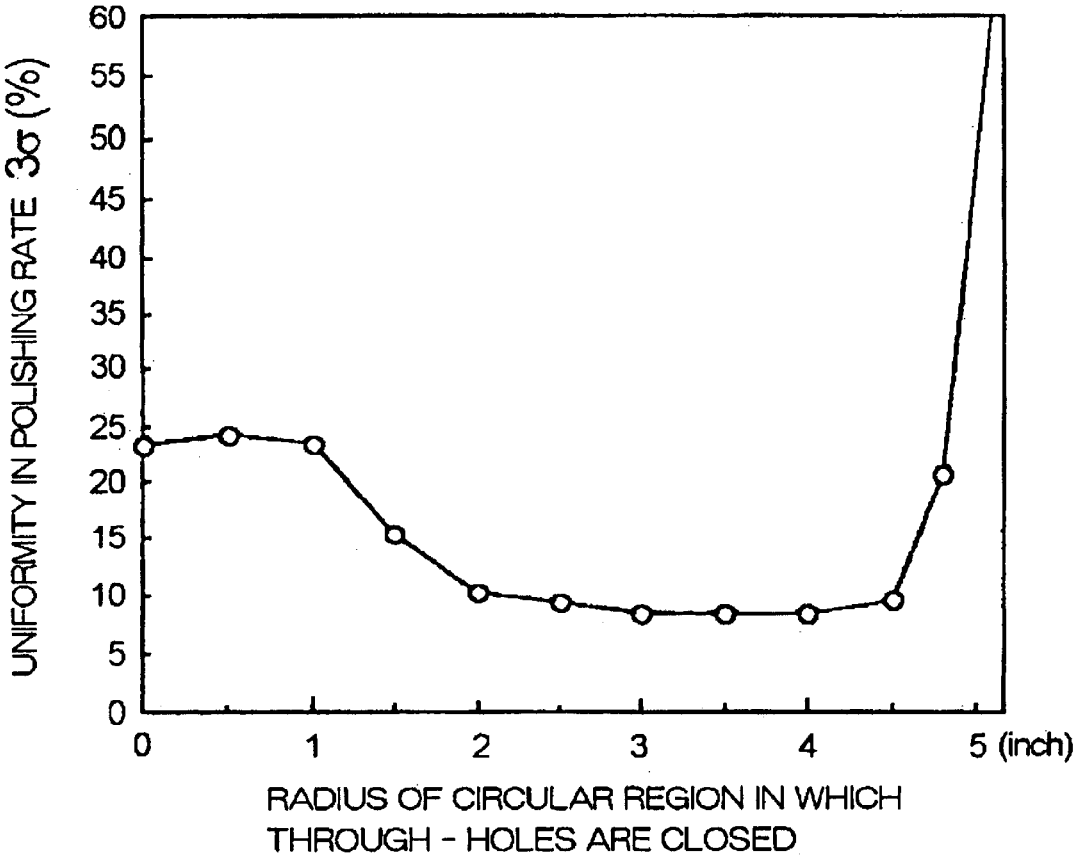
FIG. 5 is a graph showing a relation between uniformity in a polishing rate and a radius of a circular region in which through-holes are closed.

FIG. 5 shows uniformity in a polishing rate in this experiment. The uniformity was estimated with 3σ (%). The polishing conditions were as follows.

Pressure: 3 psi r.p.m.: 260/16

Polishing slurry supply: 100 cc/minute

The polishing slurry having been employed in this experiment was commercially available one.

As is obvious in view of FIG. 5, the uniformity represented by 3σ is equal to or smaller than 15%, if the polishing pad had a circular region in which no though-holes are formed and which is concentric to a center of the polishing pad and has a diameter in the range of 1.5 inches to 4.7 inches. In particular, there is obtained high uniformity equal to or smaller than 10%, if the wafer had a diameter in the range of 2 inches to 4.5 inches.

Figure 3C:
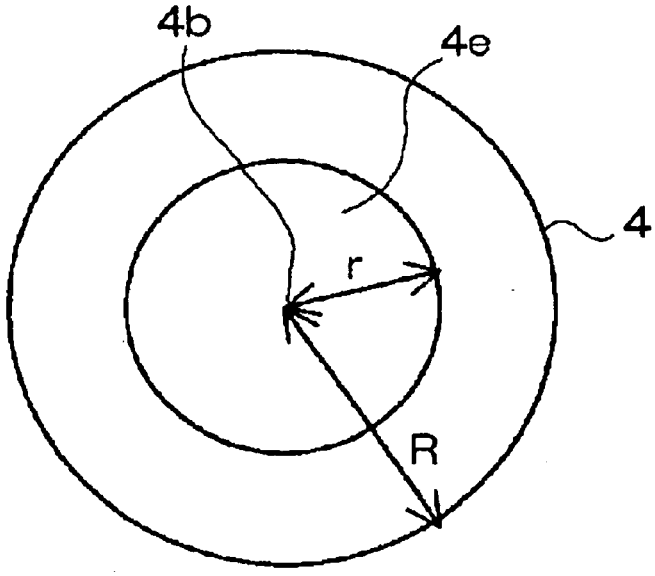
FIG. 3C is a plan view of another polishing pad employed in the apparatus illustrated in FIG. 3A.

Thus, it is understood from these results that high uniformity in a polishing rate can be obtained, if a region 4*e* where no through-holes are formed is formed as a circular region concentric to the polishing pad and having a radius equal to or smaller than 95% of a radius of the polishing pad, as illustrated in FIG. 3C.

In addition, it is also understood that it is preferable that the region 4*e* has a radius equal to or greater than 30% of a radius of the polishing pad, as illustrated in FIG. 3C.

In brief, the region 4*e* where no through-holes are formed preferably has a radius equal to or smaller than 0.95R, but equal to or greater than 0.3R where R indicates a radius of the polishing pad 4.

In particular, high uniformity in a polishing rate can be obtained in a 8-inch wafer having been employed in the experiment, if no through-holes are formed in the polishing pad within a circular region concentric to a center of the polishing pad and having a radius of 4 inches, which is equal to a radius of the 8-inch wafer, when a rotation axis of the polishing pad is in alignment with a rotation axis of the wafer.

Then, rates of polishing Ta and TiN both of which are generally used as material of which a barrier film is composed were also estimated. In the experiment for estimating the polishing rates, the through-holes of the polishing pad were all closed in a circular region concentric to a center of the polishing pad and having a radius of 4 inches, and then, the through-hole located closer to a center of the polishing pad was made open one by one. Uniformity in a polishing rate, represented by 3σ, was estimated in the same manner as the above-mentioned estimation.

Figure 6:
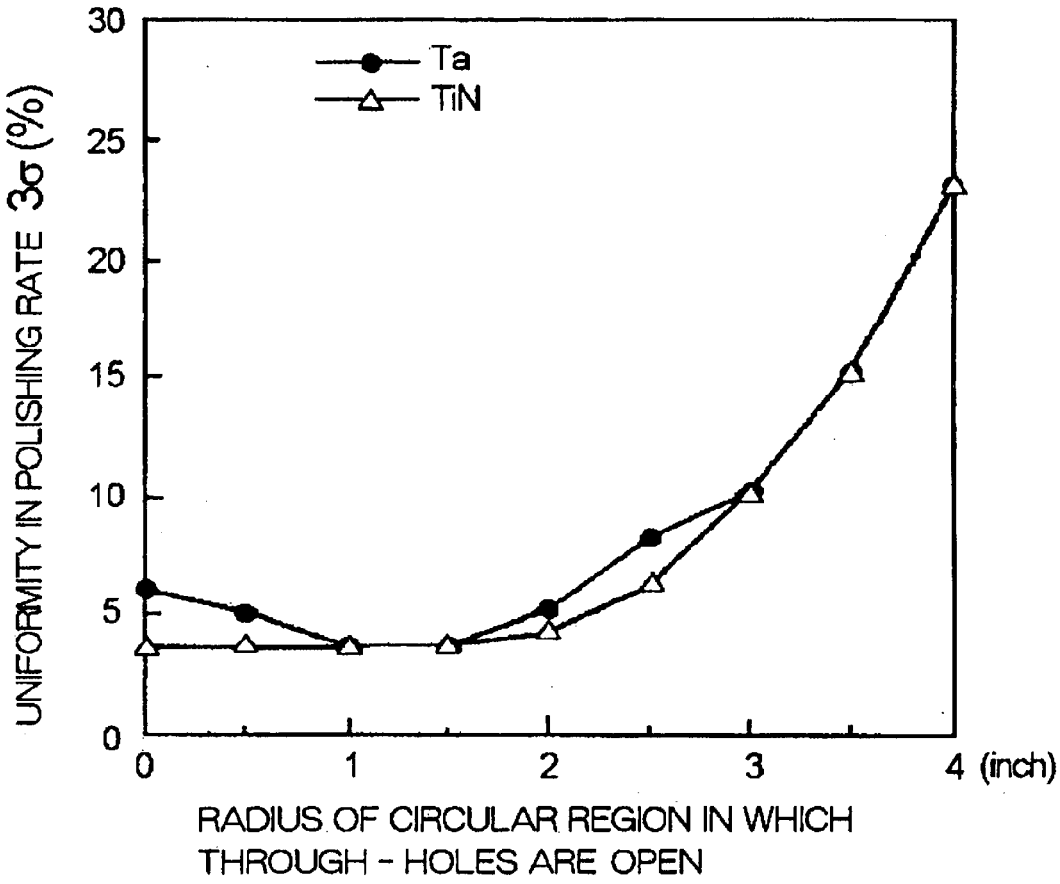
FIG. 6 is a graph showing a relation between uniformity in a polishing rate and a radius of a circular region in which through-holes are open.

FIG. 6 shows the results of the experiment. As is understood in view of FIG. 6, uniformity of 15% or smaller can be obtained, even if the through-holes are made open in a circular region concentric to the polishing pad and having a radius of 3.5 inches. That is, if the polishing pad is designed to have a region where no through-holes are formed, which region has a width of 0.5 inches or greater, sufficient uniformity in a polishing rate can be obtained. Herein, 0.5 inches correspond to 10% of a radius of the polishing pad.

There is a slight dispersion in uniformity in a polishing rate in dependence on material of which the polishing pad is composed. For instance, when a film composed of Ta harder than TiN is to be polished, it is optimal that the through-holes are formed in a circular region concentric to a center of the polishing pad and having a radius in the range of 1.0 to 1.5 inches.

EXAMPLE 2

A semiconductor device was fabricated in accordance with the steps illustrated in FIGS. 1A to 1E.

Figure 1A:
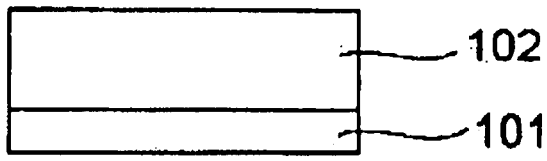
FIG. 1A PRIOR ART
FIGS. 1A to 1E are cross-sectional views of a semiconductor device, illustrating respective steps of a method of forming a buried metal layer by chemical mechanical polishing.

First, as illustrated in FIG. 1A, a semiconductor substrate 101 including active devices fabricated thereon is covered entirely with an insulating film 102.

Figure 1B:
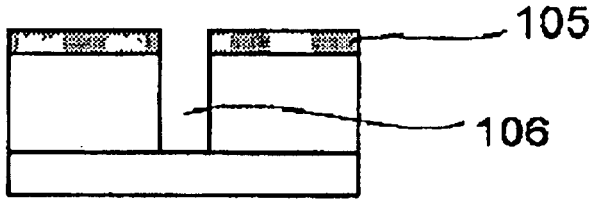
FIG. 1B PRIOR ART

Then, a resist film 105 having a certain pattern is formed on the insulating film 102, and subsequently, the insulating film 102 is etched with the patterned resist film 105 being used as a mask, to thereby form a contact hole 106 through the insulating film 102, as illustrated in FIG. 1B.

Figure 1C:
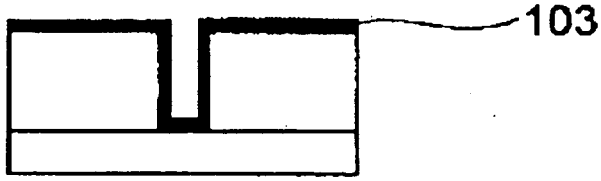
FIG. 1C PRIOR ART

After removal of the resist film 105, as illustrated in FIG. 1C, a barrier film 103 composed of metal such as Ti or Ta is deposited over the insulating film 102 so that the contact hole 106 is covered at a sidewall and a bottom thereof with the barrier film 103.

Figure 1D:
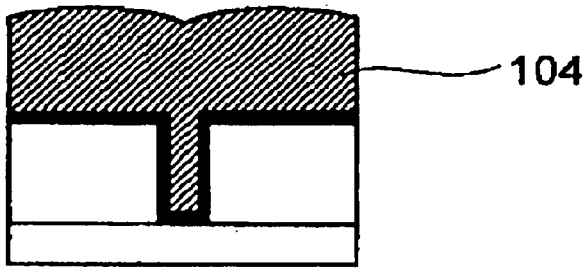
FIG. 1D PRIOR ART

Then, as illustrated in FIG. 1D, an electrically conductive layer 104 composed of copper is deposited over the barrier film 103 to thereby fill the contact hole 106 with the electrically conductive layer 104.

Figure 1E:
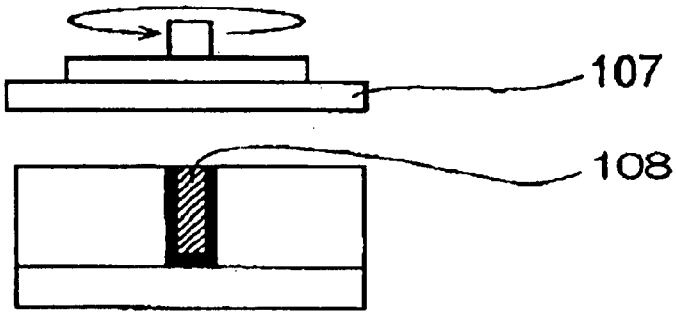
FIG. 1E PRIOR ART
Figure 2:
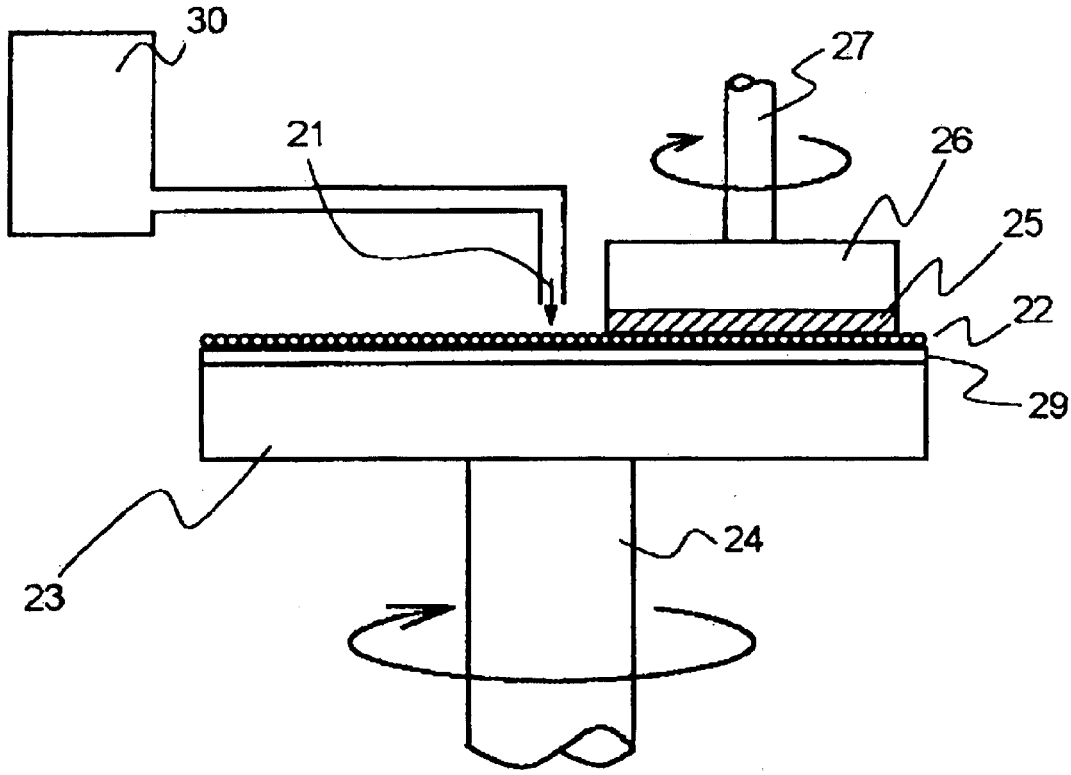
FIG.2 PRIOR ART
FIG. 2 illustrates a conventional apparatus for polishing a wafer.

Then, the electrically conductive film 104 is planarized by means of a chemical mechanical polishing apparatus 107, as illustrated in FIG. 1E. Thus, a buried metal layer 108 is formed.

In Example 2, the polishing apparatus illustrated in FIG. 3A was used as the chemical mechanical polishing apparatus 107. A wafer to which the steps having been explained with reference to FIGS. 1A to 1D had been carried out was polished by means of the polishing apparatus in the following conditions.

Polishing pressure: 3 psi r.p.m.: 260/16

Polishing slurry supply: 100 cc/minute

The polishing slurry having been employed in this experiment was commercially available. The polishing pad having been employed in this experiment was designed to have a circular region concentric thereto and having a radius of 4 inches.

The thus fabricated semiconductor device was estimated with respect to resistance to electro-migration (EM). There was obtained quite high EM-resistance.

Figure 7:
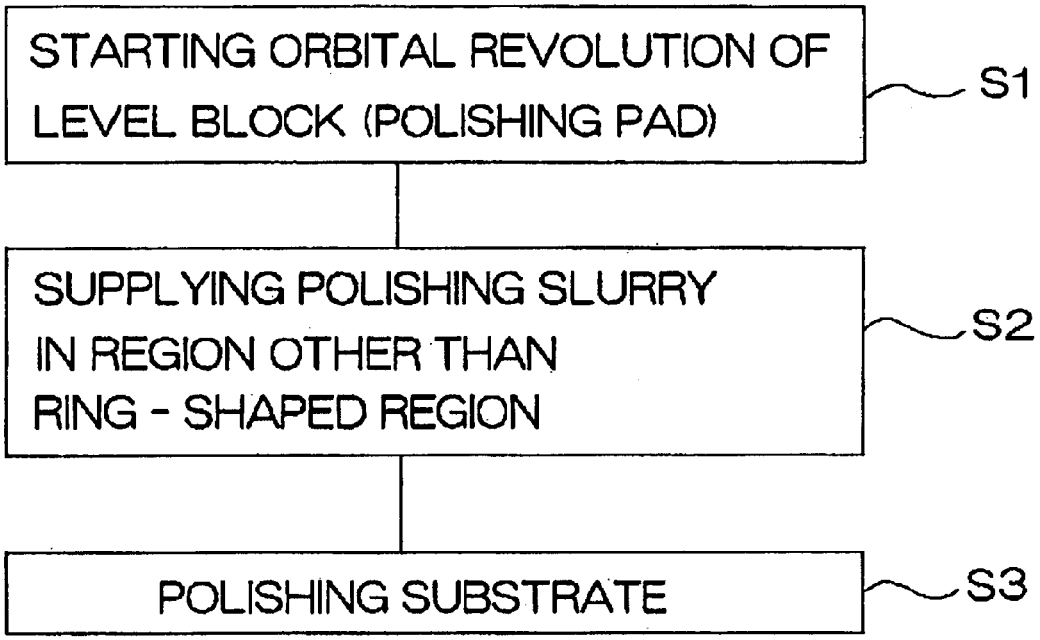
FIG. 7 is a flow chart of a method of polishing a wafer.

FIG. 7 is a flow chart of a method in accordance with the present invention.

Hereinbelow is explained the method in the assumption that the method is carried out through the use of the polishing apparatus illustrated in FIG. 3A.

First, in step S1, the level block 3 and hence the polishing pad 4 are made to carry out orbital revolution relative to the wafer 1 supported at a bottom of the carrier 2. Specifically, the polishing pad 4 is rotated around the rotation axis 3A, and at the same time, the rotation axis 3A is rotated around the rotation axis 1A of the wafer 1 in such a manner as illustrated in FIG. 4.

Then, in step S2, the polishing slurry 6 is supplied onto a surface of the polishing pad 4 while the wafer 1 is being polished by the polishing pad 4, only in a region other than the ring-shaped region 4*a* concentric to the polishing pad 4.

Thus, the wafer 1 is polished with uniformity in a polishing rate, in step 3.

The above-mentioned method provides the same advantages as those obtained by the polishing apparatus in accordance with the above-mentioned embodiment.

In the above-mentioned method, the polishing pad 4 may be designed to be formed with a circular region where no through-holes are formed, such as the circular region 4*e* illustrated in FIG. 3C, in place of the ring-shaped region 4*a*.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 10-45372 filed on Feb. 26, 1998 including specification, claims, drawings and summary is incorporated herein by reference in its entirety.

What is claimed is:

1. An apparatus for polishing a substrate, comprising:

(a) a polishing pad formed with a plurality of through-holes through which polishing material is supplied to a surface of said pad;

(b) a level block on which said polishing pad is mounted; and (c) a rotatable carrier for supporting a substrate thereon, said carrier being positioned in facing relation with said level block;

said level block being rotatable around a rotation axis thereof with said rotation axis being moved along an arcuate path, and causing said polishing pad to make contact with said substrate for polishing said substrate, said polishing pad having a first ring-shaped region concentric thereto where no through-holes through which polishing material is supplied are formed.

2. The apparatus as set forth in claim 1, wherein said first ring-shaped region has a width equal to or greater than 10% of a radius of said polishing pad.

3. The apparatus as set forth in claim 2, wherein said first ring-shaped region has a width equal to or greater than 20% of a radius of said polishing pad.

4. The apparatus as set forth in claim 1, wherein said through-holes are positioned in alignment with a peripheral region of said substrate when an axis of said level block is in alignment with an axis of said carrier.

5. The apparatus as set forth in claim 1, wherein said through-holes are positioned in a second ring-shaped region having an outer periphery common to an outer periphery of said polishing pad and having a width equal to 5% or smaller of a radius of said polishing pad.

6. The apparatus as set forth in claim 1, wherein said polishing pad includes a circular region concentric to said polishing pad and located inside said first ring-shaped region, and a third ring-shaped region located outside said first ring-shaped region, said circular region and said third ring-shaped region including said through-holes therein.

7. The apparatus as set forth in claim 6, wherein said third ring-shaped region has an outer periphery common to an outer periphery of said polishing pad.

8. The apparatus as set forth in claim 6, wherein said through-holes formed in said third ring-shaped region are positioned in alignment with a peripheral region of said substrate when an axis of said level block is in alignment with an axis of said carrier.

9. The apparatus as set forth in claim 1, wherein a total area of said through-holes varies in a radius-wise direction of said polishing pad.

10. The apparatus as set forth in claim 9, wherein the number of said through-holes per a unit area decreases in a direction from an outer periphery to a center of said polishing pad.

11. The apparatus as set forth in claim 9, wherein diameters of said through-holes decrease in a direction from an outer periphery to a center of said polishing pad.

12. An apparatus for polishing a substrate, comprising:

(a) a polishing pad formed with a plurality of through-holes through which polishing material is supplied to a surface of said polishing pad;

(b) a level block on which said polishing pad is mounted; and (c) a rotatable carrier for supporting a substrate thereon, said carrier being positioned in facing relation with said level block;

said level block being rotatable around a rotation axis thereof with said rotation axis being moved along an arcuate path, and causing said polishing pad to make contact with said substrate for polishing said substrate, said polishing pad having a circular region concentric thereto where no through-holes through which polishing material is supplied are formed.

13. The apparatus as set forth in claim 12, wherein said circular region has a radius equal to or smaller than 95% of a radius of said polishing pad.

14. The apparatus as set forth in claim 12, wherein said circular region has a radius equal to or greater than 30% of a radius of said polishing pad.

15. The apparatus as set forth in claim 12, wherein said through-holes are positioned in alignment with a peripheral region of said substrate when an axis of said level block is in alignment with an axis of said carrier.

16. The apparatus as set forth in claim 12, wherein said through-holes are positioned in a ring-shaped region having an outer periphery common to an outer periphery of said polishing pad and having a width equal to 5% or smaller of a radius of said polishing pad.

17. The apparatus as set forth in claim 12, wherein a total area of said through-holes varies in a radius-wise direction of said polishing pad.

18. The apparatus as set forth in claim 17, wherein the number of said through-holes per a unit area decreases in a direction from an outer periphery to a center of said polishing pad.

19. The apparatus as set forth in claim 17, wherein diameters of said through-holes decrease in a direction from an outer periphery to a center of said polishing pad.

* * * * *

UNITED STATES PATENT AND TRADEMARK OFFICE

CERTIFICATE OF CORRECTION

PATENT NO. : 6,783,446 B1
DATED : August 31, 2004
INVENTOR(S) : Suzuki et al.

It is certified that error appears in the above-identified patent and that said Letters Patent is hereby corrected as shown below:

Column 9,
Line 33, "surface of said pad" should be -- surface of said polishing pad --.

Signed and Sealed this

Fourteenth Day of December, 2004

JON W. DUDAS
*Director of the United States Patent and Trademark Office*